US011885149B1

(12) United States Patent
Hinojosa et al.

(10) Patent No.: US 11,885,149 B1
(45) Date of Patent: Jan. 30, 2024

(54) SYSTEM WITH NON-NEWTONIAN DILATENT FLUID TO STOP HAIL DAMAGE

(71) Applicant: UIPCO, LLC, San Antonio, TX (US)

(72) Inventors: Cynthia Ann Hinojosa, Selma, TX (US); Andrew Jacob Contreras, San Antonio, TX (US); Lemont Williamson, San Antonio, TX (US); Igor Alexandre Gregorio, San Antonio, TX (US); Stephen Anthony Young, Boerne, TX (US); Jonathan Edward Seaton, San Antonio, TX (US); Shirley Elizabeth Bunton, San Antonio, TX (US); Shayna Dickson, Boerne, TX (US); Ric M. Pena, Boerne, TX (US)

(73) Assignee: United Services Automobile Association (USAA), San Antonio, TX (US)

( * ) Notice: Subject to any disclaimer, the term of this patent is extended or adjusted under 35 U.S.C. 154(b) by 198 days.

(21) Appl. No.: 17/511,728

(22) Filed: Oct. 27, 2021

Related U.S. Application Data

(60) Provisional application No. 63/106,484, filed on Oct. 28, 2020.

(51) Int. Cl.
*E04H 9/14* (2006.01)
*E04D 5/12* (2006.01)

(52) U.S. Cl.
CPC ..... *E04H 9/14* (2013.01); *E04D 5/12* (2013.01)

(58) Field of Classification Search
USPC ..... 52/3, 5; 169/13, 16
See application file for complete search history.

(56) References Cited

U.S. PATENT DOCUMENTS 1,936,732 A * 11/1933 Renard ..... A01G 9/14 62/304
4,858,395 A * 8/1989 McQuirk ..... E04B 1/94 52/63
5,829,200 A * 11/1998 Jones ..... A62C 2/10 52/3
5,983,572 A * 11/1999 Laboy ..... E04H 9/14 52/3
6,450,264 B1 * 9/2002 Christian ..... A62C 3/0292 239/208
6,742,305 B2 * 6/2004 Rogers ..... E04H 9/14 169/48
7,578,100 B2 * 8/2009 Sicurella ..... E04H 9/14 52/DIG. 14
7,673,696 B1 * 3/2010 Gunn ..... A62C 3/00 169/48
8,403,070 B1 * 3/2013 Lowe ..... A62C 3/0257 169/48
10,265,556 B1 * 4/2019 Walters ..... E04D 13/00
11,344,756 B1 * 5/2022 Kellum ..... A62C 2/24
(Continued)

*Primary Examiner* — Joshua K Ihezie
(74) *Attorney, Agent, or Firm* — Plumsea Law Group, LLC

(57) ABSTRACT

A roof protecting system for protecting the roof of a building from hail damage. The roof protecting system includes a roof covering structure adapted to cover a portion of the roof and capable of holding a non-Newtonian dilatant fluid; a deployment system to dispose the roof covering structure onto the roof; and a delivery system for delivering the non-Newtonian dilatant fluid to the roof covering structure.

5 Claims, 9 Drawing Sheets

(56) References Cited

U.S. PATENT DOCUMENTS

| | | | | |
|---|---|---|---|---|
| 2002/0023762 | A1* | 2/2002 | Kotliar | B01D 53/22 62/640 |
| 2002/0134414 | A1* | 9/2002 | Gower | E04H 9/14 135/90 |
| 2004/0035059 | A1* | 2/2004 | Meyer | A62C 2/10 52/3 |
| 2004/0074152 | A1* | 4/2004 | Rogers | E04B 1/94 52/63 |
| 2006/0150529 | A1* | 7/2006 | Hogg | E04H 9/14 52/3 |
| 2008/0083169 | A1* | 4/2008 | Sicurella | E04H 9/14 52/4 |
| 2010/0058695 | A1* | 3/2010 | Cropper | A62C 2/10 52/396.01 |
| 2012/0145418 | A1* | 6/2012 | Su | A62C 3/0214 169/45 |
| 2015/0068776 | A1* | 3/2015 | Douglas | A62C 3/0214 169/48 |
| 2017/0021208 | A1* | 1/2017 | Dor-El | A62C 3/0257 |
| 2020/0147423 | A1* | 5/2020 | Paull | A62C 3/0214 |
| 2020/0316421 | A1* | 10/2020 | Patzelt | C09K 21/02 |
| 2022/0023687 | A1* | 1/2022 | Eftekharzadeh | A62C 3/0257 |

* cited by examiner

SYSTEM WITH NON-NEWTONIAN DILATENT FLUID TO STOP HAIL DAMAGE

CROSS-REFERENCE TO RELATED APPLICATIONS

This application claims the benefit of U.S. provisional patent application Ser. No. 63/106,484, filed Oct. 28, 2020, and titled "System with Non-Newtonian Dilatent Fluid To Stop Hail Damage," the entirety of which is hereby incorporated by reference.

BACKGROUND

1. Field of the Disclosure

The present disclosure relates to a system using non-Newtonian dilatant fluid to protect the roof of a building from hail damage.

2. Description of Related Art

Hail can inflict severe damage to the roof of a building. For example, hail can damage and dislodge shingles on a slanted roof, re-distribute gravel on a flat roof, and puncture a membrane-type roof.

The cost of such damage may be significant. Not only may the roof be damaged, but also items within the building may be damaged by water flowing into the building through holes formed by the hail. Further, features such as skylights, clerestories, light tubes, and the like, may be damaged by hail, thus providing another pathway for moisture to enter the building.

There is a need in the art for a system and method that protects the roof of a building from hail damage.

SUMMARY OF THE INVENTION

In one aspect, the disclosure provides a roof protecting system for protecting the roof of a building from hail damage. The roof protecting system includes a roof covering structure adapted to cover at least a portion of the roof and capable of holding a non-Newtonian dilatant fluid. The roof protecting system also includes a deployment system to dispose the roof covering structure onto the roof and a delivery system for delivering the non-Newtonian dilatant fluid to the roof covering structure.

In another aspect, the disclosure provides a delivery system for delivering a non-Newtonian dilatant fluid to a roof covering structure for covering at least about portion of a roof. The system comprises a storage volume for a solid, wherein when the solid is combined with a liquid, the non-Newtonian dilatant fluid is formed. The system includes a first conduit for delivery of the solid to a control system and a second conduit for delivery of the liquid to the control system. The control system controls delivery of the solid and the liquid to a plenum in proportions that can be mixed to form the non-Newtonian dilatant fluid. The solid and the liquid undergo mixing to form the non-Newtonian dilatant fluid. The roof covering structure is fluidly connected to the plenum to receive the non-Newtonian dilatant fluid from the plenum.

In still another aspect, the disclosure provides a device for protecting a roof of a building from hail. The device includes a roof covering system adapted to hold a non-Newtonian dilatant fluid. The device also includes a fluid supply system for supplying the non-Newtonian dilatant fluid to the roof covering system and a control system to control deployment of the roof covering system and the fluid supply system.

Other systems, methods, features and advantages of the disclosure will be, or will become, apparent to one of ordinary skill in the art upon examination of the following figures and detailed description. It is intended that all such additional systems, methods, features and advantages be included within this description and this summary, be within the scope of the disclosure, and be protected by the following claims.

BRIEF DESCRIPTION OF THE DRAWINGS

The disclosure can be better understood with reference to the following drawings and description. The components in the figures are not necessarily to scale, emphasis instead being placed upon illustrating the principles of the disclosure. Moreover, in the figures, like reference numerals designate corresponding parts throughout the different views.

DETAILED DESCRIPTION

Hail may damage a significant fraction of building structures. The cost of repairs is related to the frequency of damage and severity of damage. Therefore, protection of a roof from hail damage may be cost-effective if damaging hail is a frequent occurrence. As a roof is an important part of the design and appearance of a structure, removable or stowable protection that contributes to the appearance and function of the roof may be particularly useful.

Figure 1:
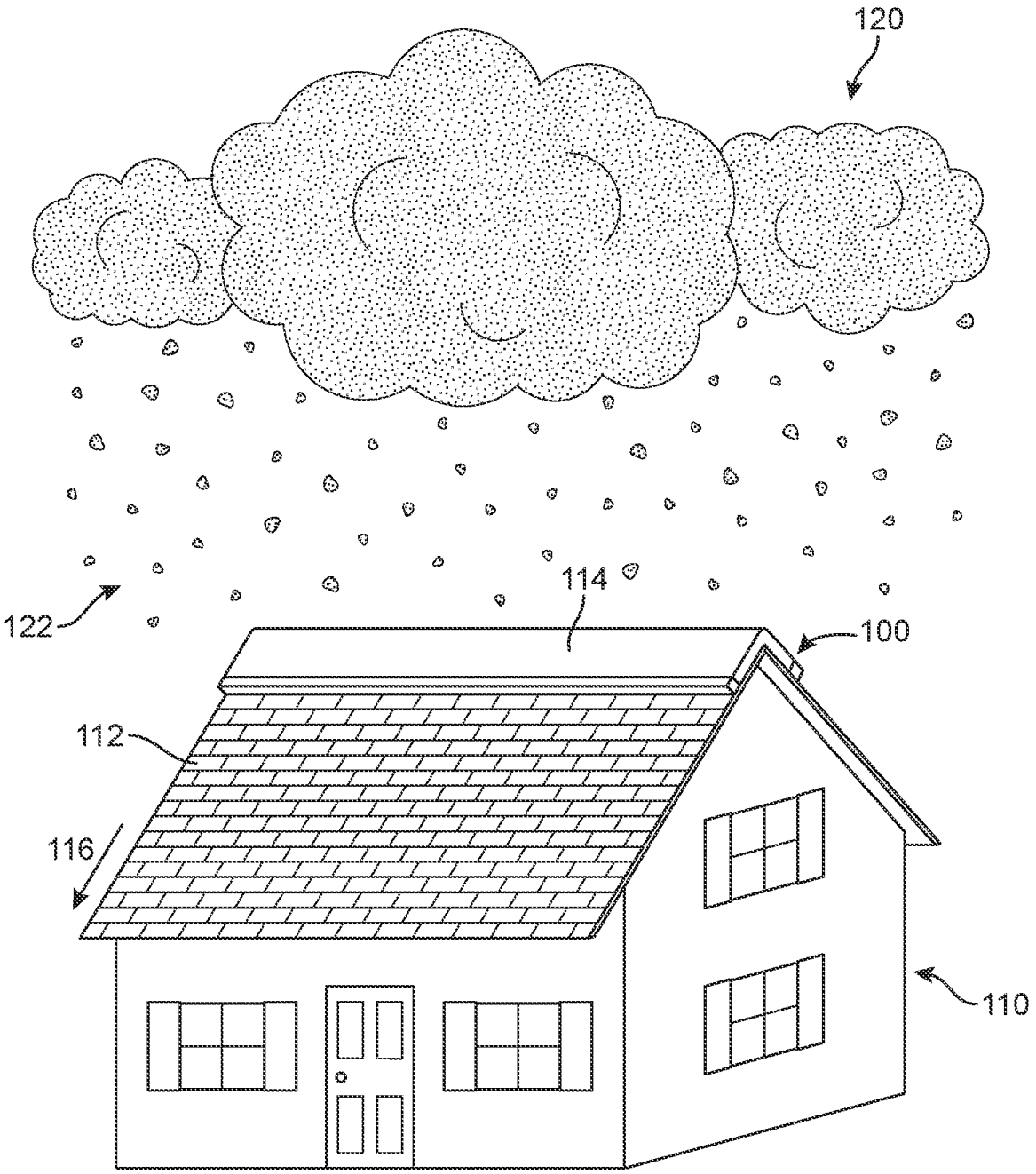
FIG. 1 depicts a schematic view of a building as a hail storm starts, according to an embodiment.

FIG. 1 illustrates portions of roof protecting system 100 for protecting roof 112 of building 110 from hail damage. Roof protecting system 100 includes roof cap 114 at the peak of the roof. Roof cap 114 extends down each side of the roof and houses parts of roof protecting system 100 (see FIG. 4). Roof cap 114 may be painted or shaped to match the roof covering. FIG. 1 illustrates storm clouds 120 from which hail 122 is falling. As can be seen in FIG. 1, roof 112 slopes downwardly in the direction of slope arrow 116, and roof protecting system 100 may extend laterally across the entirety of the roof. However, embodiments may be used to protect only part of the roof laterally or vertically. Embodiments also may be adapted to a variety of roofline shapes.

Figure 2:
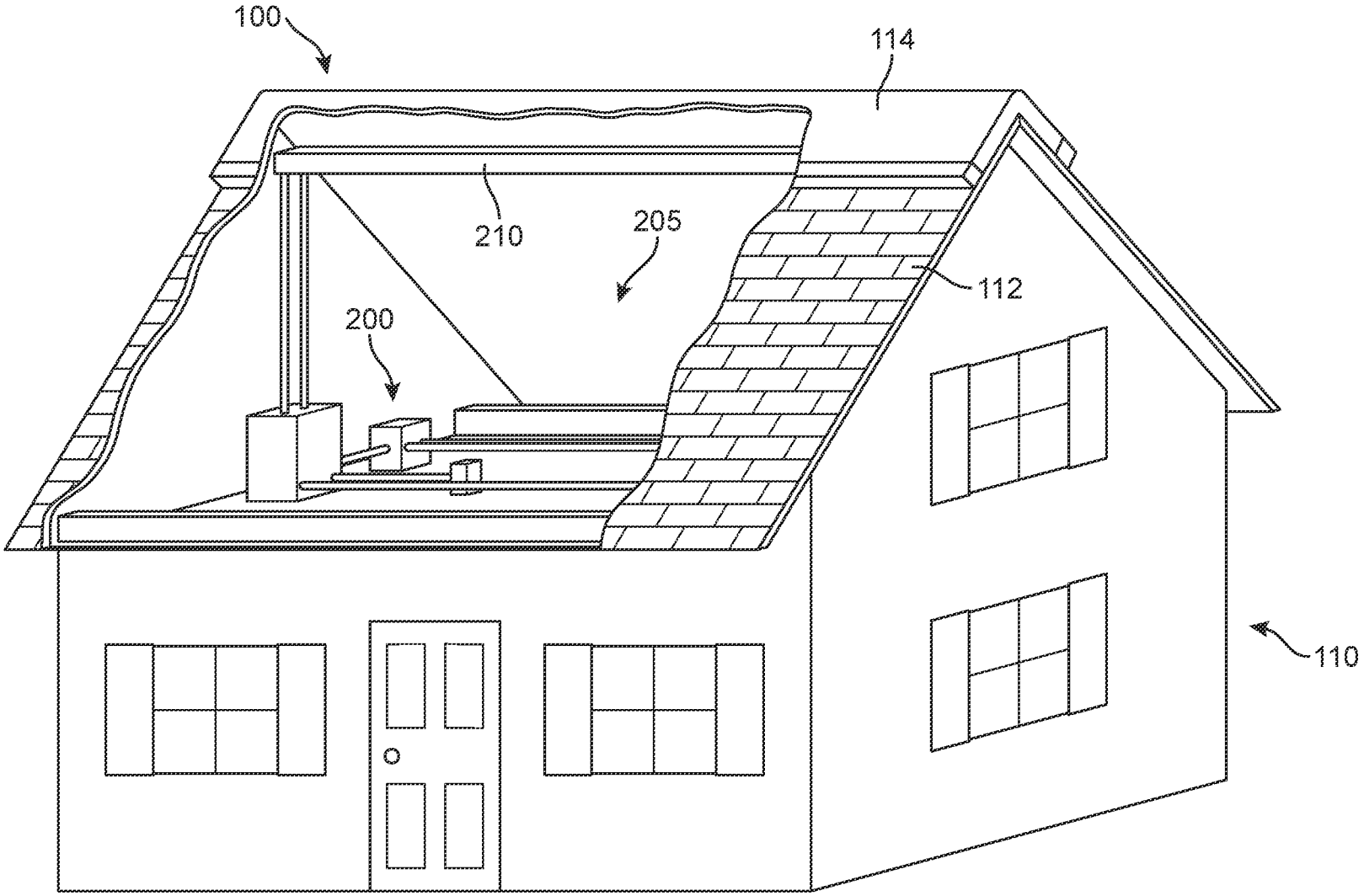
FIG. 2 is a cut-away view of a building showing some components of a roof protecting system, according to an embodiment of the disclosure.

FIG. 2 illustrates building 110 with a cutaway roof section to illustrate parts of roof protecting system 100 typically found in the interior of the building. Roof cap 114 covers the peak of the roof and houses the external or outdoor portions of roof protecting system 100. In an embodiment, delivery system 200 for delivering the non-Newtonian dilatant fluid to the roof covering structure may be in the interior of the structure. In FIG. 2, delivery system 200 is illustrated as being in the attic space 205 adjacent the roof. In some embodiments, plenum 210 may be located at the peak of the roof to deliver non-Newtonian dilatant fluid to the roof cover (See FIG. 4), while the remainder of the delivery system may be placed conveniently in or near to building 110. The delivery system may deliver non-Newtonian dilatant fluid stored in the system or non-Newtonian dilatant fluid that is formed on site. Location of delivery system 200 close to plenum 210 reduces the number of opportunities for leakage, blockages in pipes, damage to the delivery system, and other mechanical and physical difficulties.

Figure 3:
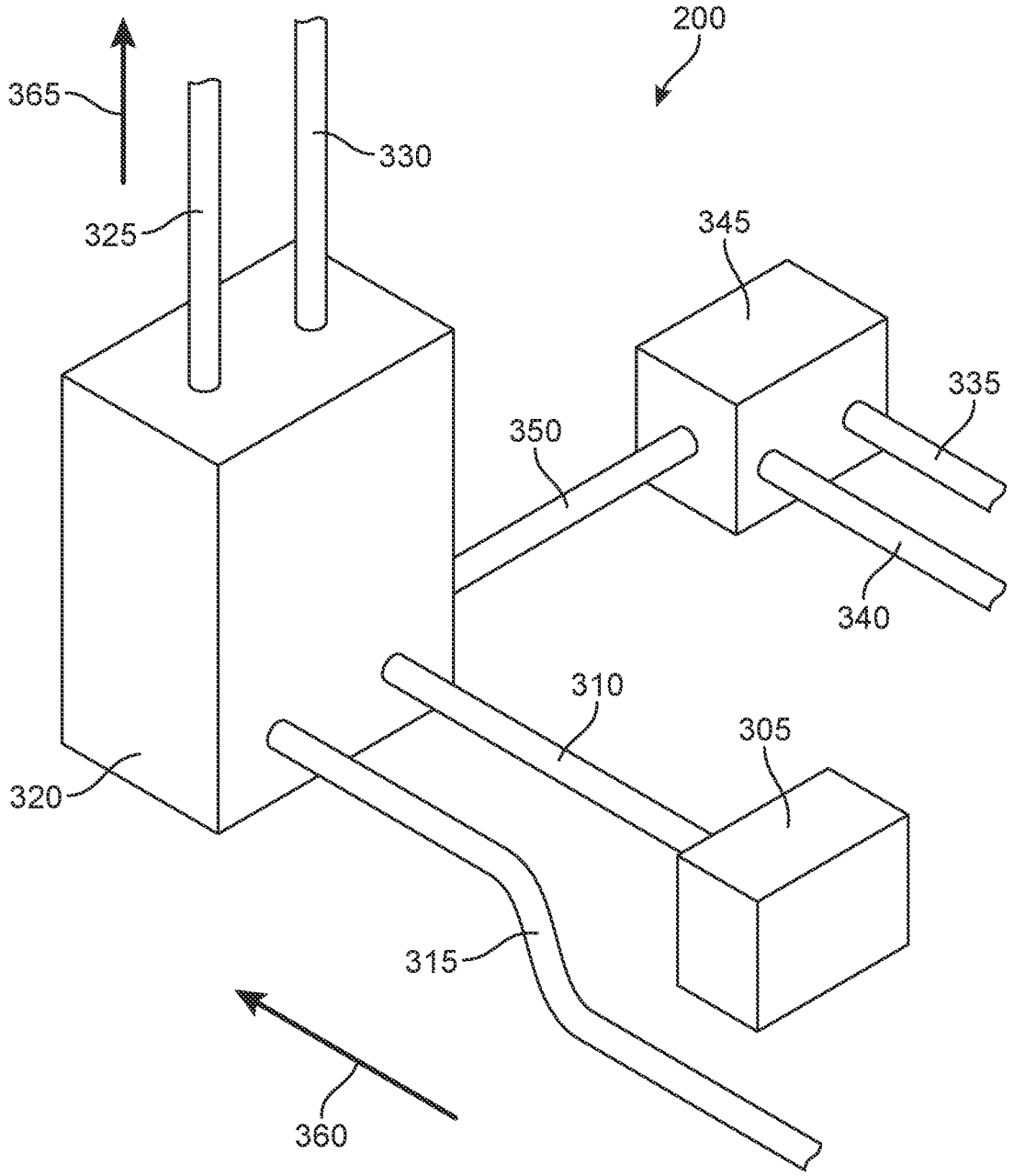
FIG. 3 depicts schematic components of a roof protecting system forming part of an embodiment of the disclosure.

A portion of delivery system 200 is illustrated in detail in FIG. 3. Delivery system 200 illustrated in FIG. 3 may deliver a solid and a liquid to a mixing location where the non-Newtonian dilatant fluid is formed before delivery to plenum 210. In embodiments, one such system may use corn starch as the solid and water as the liquid. Corn starch and water can be mixed in a selected ratio to form a non-Newtonian dilatant fluid. For convenience, delivery system 200 will be described with regard to a non-Newtonian dilatant fluid comprising corn starch and water. However, other non-Newtonian dilatant fluids having different compositions may suitably be used in embodiments of the disclosure. Also, in other embodiments, a non-Newtonian dilatant fluid may be stored on site and delivered by delivery system 200.

As shown in FIG. 3, an embodiment of delivery system 200 includes an apparatus to deliver non-Newtonian dilatant fluid to plenum 210. In embodiments, dry corn starch may be stored in container 305. Upon a command from electronic control unit 345 to deliver non-Newtonian dilatant fluid to plenum 210, dry corn starch may be delivered through first dry corn starch conduit 310 to system control unit 320 in direction of flow indicated by flow arrow 360. Water is delivered through first water conduit 315 to system control unit 320 in the same direction of flow indicated by flow arrow 360. System control unit 320 simultaneously delivers to plenum 210, in the direction of flow arrow 365, the correct proportion of dry corn starch through second dry corn starch conduit 330 and of water through second water conduit 325. In embodiments, non-Newtonian dilatant fluid stored on site may be delivered through the liquid side of delivery system 200.

In some embodiments, water may be available under sufficient pressure to be used directly. If water pressure is not sufficient, a booster pump (not shown) may be added to the delivery system. Dry corn starch may be delivered in any reasonable way. For example, dry corn starch may be delivered to plenum 210 pneumatically, using air pressure. In other embodiments, a screw or spiral conveyor or a bucket conveyor may be suitable for moving dry corn starch to higher elevations.

In embodiments, electronic control unit 345 controls operation of delivery system 200. Electronic control unit 345 sends signals to system control unit 320 by way of line 350. In some embodiments, electronic control unit 345 may send electric signals to system control unit 320. These electric signals may command system control unit 320 to initiate flow of dry corn starch and water. In some embodiments, electronic control unit 345 may send other types of signals, such as pneumatic signals to provide pneumatic control. Signals from electronic control unit 345 provide system control unit 320 instructions relating to preparation and delivery of non-Newtonian dilatant fluid to plenum 210. For example, electronic control unit 345 may control the relative proportions of dry corn starch and water, and the quantity of dry corn starch and water, to deliver to plenum 210. The proportions of dry corn starch and water control the properties and characteristics of the non-Newtonian dilatant fluid, and the quantity of dry corn starch and water controls the thickness of the resultant roof protection.

Electronic control unit 345 may receive electrical power for operation through electrical line 340. In some embodiments, electronic control unit 345 receives information related to the need to deploy roof protecting system 100 from communication line 335. Signals received by way of line 335 may include weather-related information, including predicted and actual temperature, wind speed, likelihood of precipitation, and type of precipitation, for example. Weather alerts; emergency broadcasts; precipitation sensors, especially hail sensors; and reports from the locality or from adjacent localities also may be useful. Information may be broadcast to a broadcast receiver in the electronic control unit or otherwise delivered to the electronic control unit.

In some embodiments, therefore, electronic control unit 345 may be autonomous. Such operation may be particularly convenient when the building is unattended or vacant, or when personnel authorized to operate the roof protecting system are not present. In such circumstances, the autonomous control system may be adapted to receive information from weather alerts and broadcasts, system hail sensors, neighboring systems, and reports of the location and severity of hail. Any relevant information useful in determining whether to deploy the roof protecting system may be considered.

In some embodiments, electronic control unit 345 may be manually operable. Manual operation may be available on site, or may be available remotely. Manual operation may be used to operate the roof protecting system if the autonomous system has not operated the roof covering system when it was required. Manual operation also may be used to stop roof protecting system 100 from deploying under selected circumstances, such as error in automatic start, workers or objects on the roof, significant internal leakage, damage to the roof, or other faults.

In embodiments, the roof protecting system includes a roof covering structure adapted to cover a portion of the roof and capable of holding a non-Newtonian dilatant fluid. The system also includes a deployment system to dispose the roof covering structure onto the roof.

Figure 4:
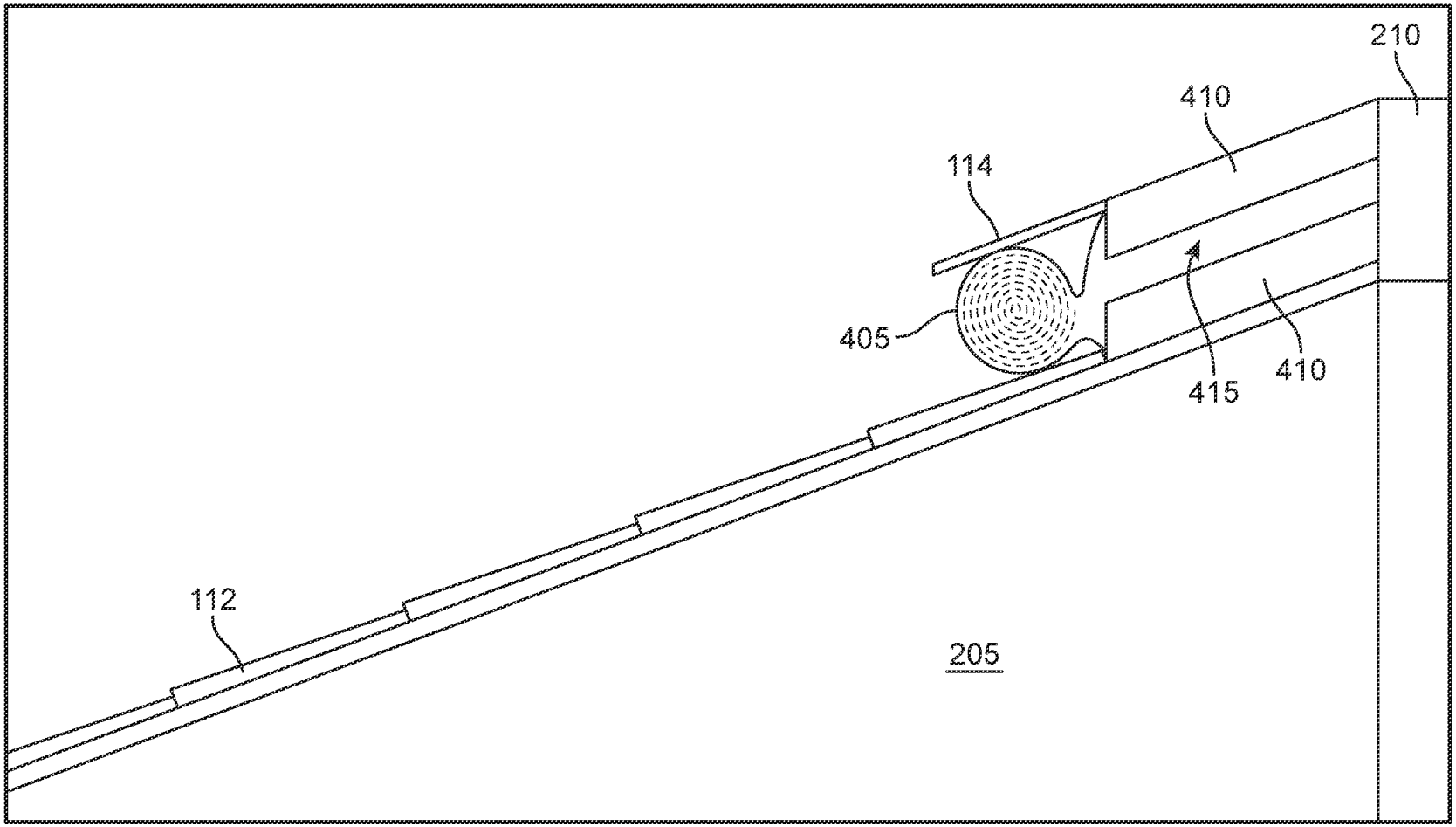
FIG. 4 is a schematic view of a portion of a roof protecting system according to an embodiment of the disclosure before deployment.

FIG. 4 illustrates an embodiment of a deployment system for an embodiment of a roof covering structure. Plenum 210 serves to deliver non-Newtonian dilatant fluid through distribution channel 415 in distribution housing 410 to roof covering structure 405. In such an embodiment, the delivery system is within roof cap 114.

In the embodiment illustrated in FIG. 4, roof covering structure 405 is housed within roof cap 114 at the peak of roof 112. Roof covering structure 405 may retain a shape during storage without any bindings, or may be retained by impinging on roof cap 114 until deployed. In some embodiments, roof covering structure 405 may be deployed by being filled with non-Newtonian dilatant fluid. As roof covering structure 405 is filled, it may unroll and extend over roof 112. In some embodiments, roof covering structure 405 may be extended by releasing a binding and allowing roof covering structure 405 to extend down roof 112 by gravity. In some embodiments, roof covering structure 405 may be urged to unroll by a spring or other motive factor (not shown). The roof covering structure 405 may be extended by manual command or by command from the control unit, and may be extended before non-Newtonian dilatant fluid is delivered.

Figure 5:
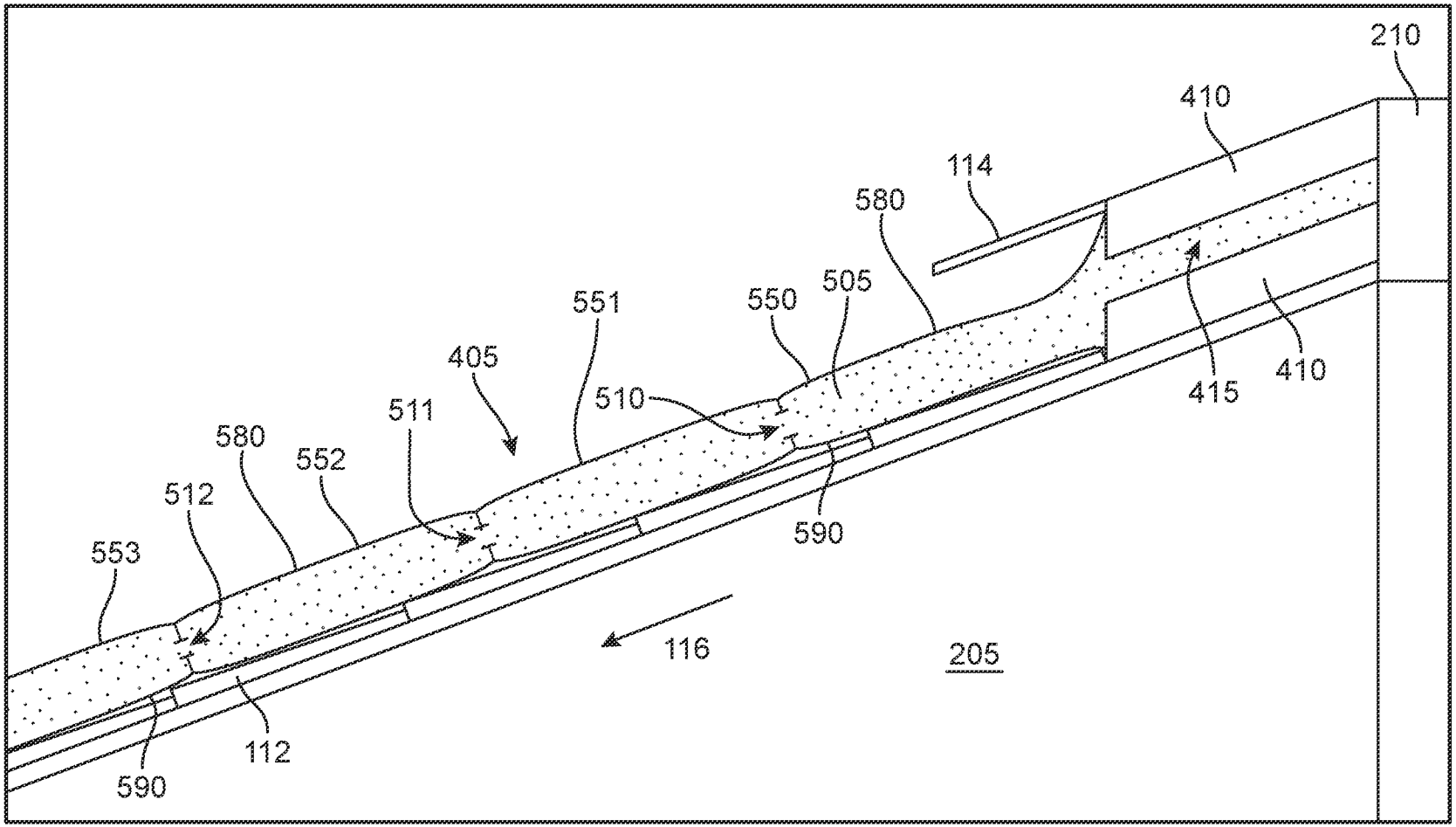
FIG. 5 is a view of a roof protecting system in a partially deployed state, according to an embodiment of the disclosure.
Figure 6:
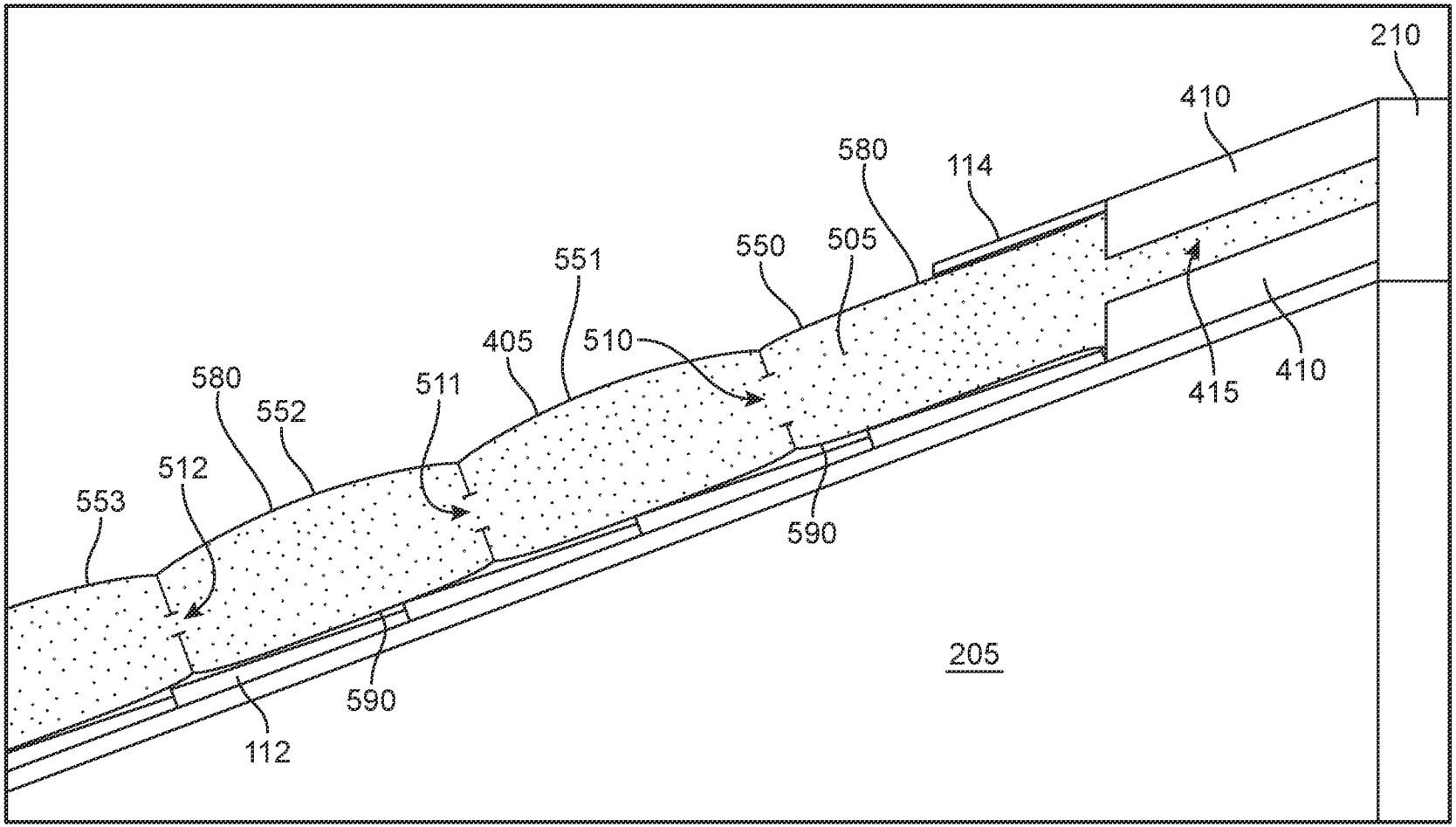
FIG. 6 is a view of a roof protecting system deployed over a roof, according to an embodiment of the disclosure.
Figure 7:
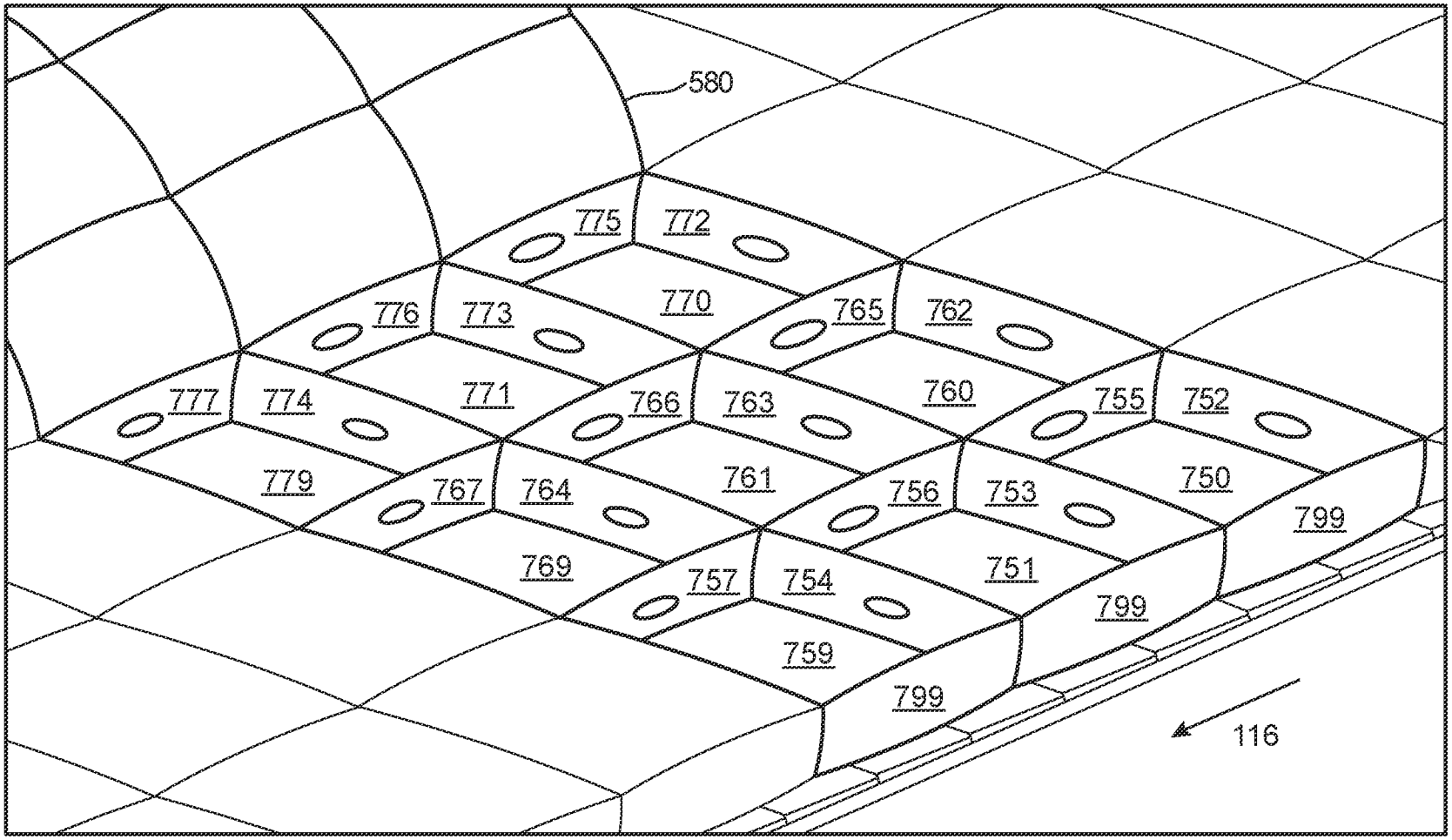
FIG. 7 is a cut-away view of a portion of the interior of a roof protecting system according to an embodiment of the disclosure.

Turning now to FIG. 5 and FIG. 6, non-Newtonian dilatant fluid 505 has flowed into roof covering structure 405. FIG. 7 illustrates a cutaway portion illustrating the interior of roof covering structure 405. Roof covering structure 405 may include upper surface 580 and lower surface 590. Roof covering structure 405 also may be divided by dividers into compartments extending laterally across roof 112 and in the direction of slope arrow 116.

Non-Newtonian dilatant fluid 505 flows from distribution channel 415 and into a first compartment 550 of roof covering structure 405. As more non-Newtonian dilatant fluid is delivered, non-Newtonian dilatant fluid 505 continues to flow downward through first apportioning valve 510 to second compartment 551. As more and more non-Newtonian dilatant fluid is delivered, non-Newtonian dilatant fluid in second compartment 551 flows into third compartment 552 through second apportioning valve 511, and then into fourth compartment 553 by way of third apportioning valve 512.

The apportioning valves form separations between compartments. The apportioning valves thus tend to prevent all of the non-Newtonian dilatant fluid from flowing to the bottom of the roof. Apportioning valves may be designed to ensure that non-Newtonian dilatant fluid remains in each of the compartments. In this way, a quantity of non-Newtonian dilatant fluid may be retained in first compartment 550, second compartment 551, and in other compartments down the roof. Apportioning valves in the downward direction also work in cooperation with lateral apportioning valves (see FIG. 7) to provide fluid balance in the lateral direction.

FIG. 5 illustrates an embodiment wherein roof covering structure 405 is approximately half full of non-Newtonian dilatant fluid. FIG. 6 illustrates an embodiment wherein roof covering structure 405 is approximately full of non-Newtonian dilatant fluid. As can be seen by comparing FIG. 5 and FIG. 6, when first compartment 550, second compartment 551, third compartment 552, and fourth compartment 553 are full, as in FIG. 6, the thickness of roof covering structure 405 is greater than when first compartment 550, second compartment 551, third compartment 552, and fourth compartment 553 are only half-full, as in FIG. 5. The thickness of non-Newtonian dilatant fluid in roof covering structure 405 may be controlled by controlling the volume of non-Newtonian dilatant fluid delivered to roof covering structure 405.

Roof covering structure 405 may include lateral apportioning valves that serve as dividers between compartments to ensure essentially equal fill laterally across the roof. Although plenum 210 typically is designed to distribute non-Newtonian dilatant fluid equally along the roof, flow imbalances may occur. For example, an opening between plenum 210 and distribution channel 415 may become blocked. Thus, roof covering structure 405 may include dividers distributed laterally across the roof. Selected numbers of the dividers also may have apportioning valves placed therein to allow lateral flow of non-Newtonian dilatant fluid.

FIG. 7 illustrates a cut-away portion 700 of roof covering structure 405 with upper surface 580 removed to illustrate the location of apportioning valves and compartments. Upper surface 580 is cut-away to reveal the interior of portion 700 of roof covering structure 405. Cut-away portion 700 reveals fifth compartment 750, sixth compartment 760 laterally adjacent fifth compartment 750, and seventh compartment 770 laterally adjacent sixth compartment 760. Lateral apportioning valve 755 serves to laterally separate sixth compartment 760 from fifth compartment 750. Seventh compartment 770 is laterally separated from sixth compartment 760 by lateral apportioning valve 765 and is laterally separated from an adjacent compartment (not shown) by lateral apportioning valve 775.

Similarly, FIG. 7 illustrates eighth compartment 751, ninth compartment 761 laterally adjacent to eighth compartment 751, and tenth compartment 771 laterally adjacent to ninth compartment 761. Lateral apportioning valve 756 serves to laterally separate ninth compartment 761 from eighth compartment 751. Tenth compartment 771 is laterally separated from ninth compartment 761 by lateral apportioning valve 766 and is laterally separated from an adjacent compartment (not shown) by lateral apportioning valve 776.

FIG. 7 also illustrates eleventh compartment 759, twelfth compartment 769 laterally adjacent to eleventh compartment 759, and thirteenth compartment 779 laterally adjacent to twelfth compartment 769. Lateral apportioning valve 757 serves to laterally separate twelfth compartment 769 from eleventh compartment 759. Thirteenth compartment 779 is laterally separated from twelfth compartment 769 by lateral apportioning valve 767 and is laterally separated from an adjacent compartment (not shown) by lateral apportioning valve 777.

FIG. 7 also illustrates the arrangement of apportioning valves in the direction of slope arrow 116. Fifth compartment 750 is separated from a compartment (not shown) above, or in the direction opposite that of slope arrow 116, by apportioning valve 752. In the direction of the slope arrow, apportioning valve 753 separates eighth compartment 751, and apportioning valve 754 separates eleventh compartment 759.

FIG. 7 further illustrates that sixth compartment 760 is separated from a compartment (not shown) above, or in the direction opposite that of slope arrow 116, by apportioning valve 762. In the direction of the slope arrow, apportioning valve 763 separates ninth compartment 761, and apportioning valve 764 separates twelfth compartment 769. FIG. 7 further illustrates seventh compartment 770 separated from a compartment (not shown) above, or in the direction opposite that of slope arrow 116, by apportioning valve 772. In the direction of the slope arrow, apportioning valve 773 separates tenth compartment 771, and apportioning valve 774 separates eleventh compartment 759.

In embodiments, the lateral edge 799 is closed to prevent non-Newtonian dilatant fluid from flowing laterally out of the roof covering structure. Last, or bottom-most, compartments in the direction of flow arrow 116, are similarly closed to prevent non-Newtonian dilatant fluid from flowing out of the bottom of the roof covering structure.

In some embodiments, non-Newtonian dilatant fluid flows downward from distribution channel 415 into first compartment 550, and then down the roof in the direction of slope arrow 116 through apportioning valves and compartments. Non-Newtonian dilatant fluid also may flow laterally through lateral apportioning valves into adjacent compartments.

In embodiments, roof covering structure 405 is made of a flexible material so as to be stored within roof cap 114. As shown in FIG. 5, roof covering structure 405 is rolled for storage. In other embodiments, roof covering structure 405 may be fan-folded or otherwise arranged.

Roof covering structure 405 may be made from a selection of materials. For example, cloth or papers, woven or non-woven, and other materials may be chosen. Different materials may be used at the simultaneously. For example, the portion that may contact the roof may be an abrasion-resistant material, and the portion impacted by the hail may be less abrasion resistant, such as a non-woven fabric that may better resist penetration by the hail.

Roof covering structure 405 may be re-usable or may be discarded upon use. The choice to re-use the structure may depend upon the properties and characteristics of the non-Newtonian dilatant fluid used. For example, corn starch may attract insects and other pests. A re-usable structure may be returned to storage within roof cap 114. In other embodiments, a new structure may be substituted for the used structure in the system. Both a re-usable roof covering structure and a new roof covering system may have a valve at the lowest point in the system for draining the non-Newtonian dilatant fluid after use. In a roof protecting system using a water-based non-Newtonian dilatant fluid, water may be delivered through delivery system 200 to plenum 210 and then through roof covering structure 405 to rinse non-Newtonian dilatant fluid from the interior of the roof covering structure.

The thickness of the fill or the resistance of the non-Newtonian dilatant fluid in roof covering structure 405 may be adjusted to ensure that hail of selected sizes is prevented from reaching roof 112. Typically, hail less than 25 mm (1 inch) in diameter may do only minor damage to a roof. However, to avoid any chance of damage, roof covering structure 405 may be filled to preclude damage from hail up to 25 mm (1 inch) in diameter. As larger hail is more likely to cause damage, the roof covering structure 405 may be filled to preclude damage from 50 mm (2 inch) hail, 75 mm (3 inch) hail, 100 mm (4 inch) hail, 125 mm (5 inch) hail, 150 mm (6 inch) hail, and larger hail. The thickness of the fill will be dependent on the properties and characteristics of the non-Newtonian dilatant fluid.

Figure 8:
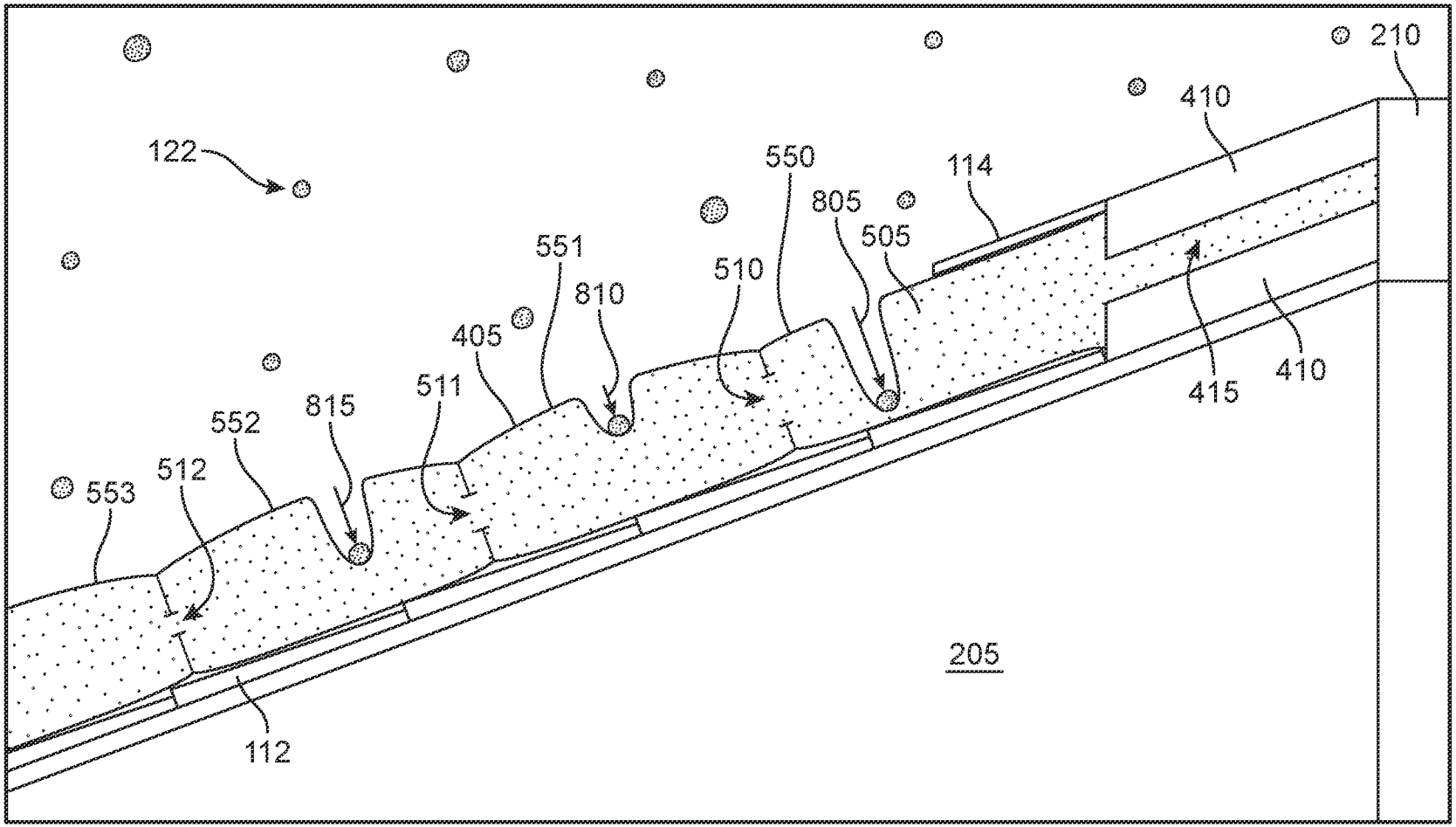
FIG. 8 is a schematic view of a portion of the roof protecting system protecting a roof from hail, according to an embodiment.

FIG. 8 illustrates roof covering structure 405 precluding contact between hail 122 and roof 112. Hail has penetrated the roof covering structure 405 to a first depth 805, a second depth 815, and a third depth 810. The depths, ranging from the shallow depth 810 to the deepest depth 805, may be caused by different energies of impact. Often, hail during a storm is not approximately the same size, and falls at different rates. The velocity at contact typically may be the terminal speed of the hail, with larger hail stones having higher terminal speed. The faster the hail stone falls, and the greater the mass of the hail stone, the greater the energy that will be imparted. Also, wind-blown hail will impart even more energy.

For example, a 25 mm hail stone may have a terminal velocity of about 22 m/sec, and may have an impact energy of about 1.4 J. A 50 mm hail stone may have a terminal velocity of about 32 m/sec and may have an impact energy of about 20.8 J. A 100 mm (4 inch) hail stone may have a terminal velocity of at least about 40 m/sec and an impact energy of about 80 J. The force absorbed by the roof covering structure 405 will be related to the angle of the roof. A steep roof may tend to deflect hail stones, whereas a flat roof will be subjected to the full impact.

FIG. 8 may be considered illustrative of hail stones that are small, generating depth 810; a bit larger, generating depth 815; or still larger, generating depth 805. As can be seen, if roof covering structure 405 is designed and utilized to protect against the largest hail, it will protect against smaller hail as well.

As can be seen, a compartment may deform and bulge at the upper surface 580 when a hail stone strikes roof covering structure 405. Such bulging may be more pronounced if a hail stone is adsorbed into the non-Newtonian dilatant fluid volume. However, a hail stone may also bounce or rebound from the surface of roof covering structure 405 and not deform a compartment upon impact.

A suitable non-Newtonian dilatant fluid may be selected by the user. A non-Newtonian dilatant fluid is one in which the viscosity of the fluid increases when shear is applied. Corn starch and water form a non-Newtonian dilatant fluid. Silly Putty® is a non-Newtonian dilatant fluid. Other non-Newtonian dilatant fluids include sand and water under selected conditions. A non-Newtonian dilatant fluid also may be known as a shear-thickening fluid.

The disclosure herein has been described with particularity for a non-Newtonian dilatant fluid comprising corn starch and water. The materials required to make this solution are readily available, easily stored, and relatively inexpensive. The ratio of corn starch to water may vary from between about 1 part by weight of dry corn starch to 1 part by weight of water to about 3 parts by weight of dry corn starch to 1 part by weight of water. Typically, the ratio may be between about 1.25 parts by weight of dry corn starch to 1 part by weight of water to about 2.5 parts by weight of dry corn starch to 1 part by weight of water. More typically, the ratio may be between about 1.5 parts by weight of dry corn starch to 1 part by weight of water to about 2 parts by weight of dry corn starch to 1 part by weight of water.

Figure 9:
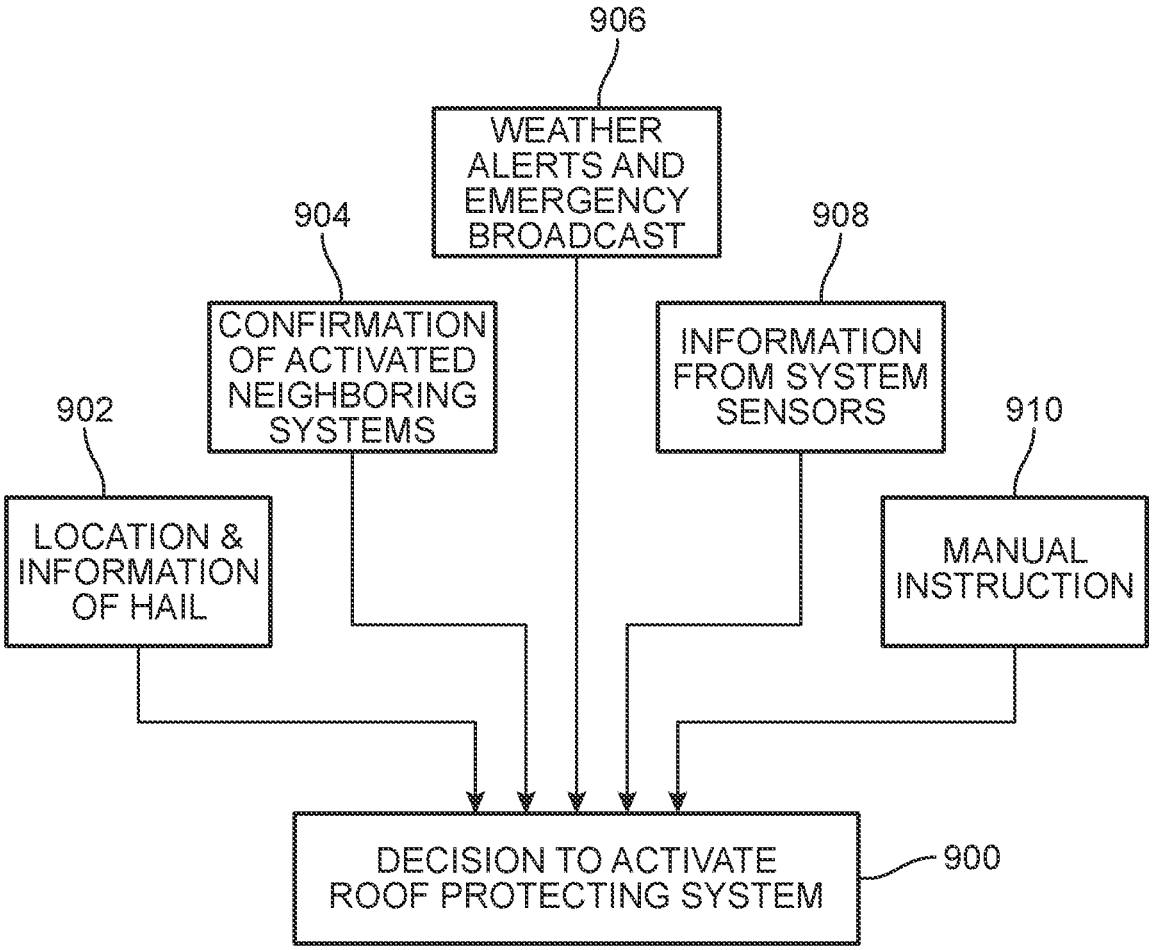
FIG. 9 is a schematic diagram depicting inputs used in deciding to activate a roof protecting system, according to an embodiment.

FIG. 9 illustrates various inputs that contribute to a decision to activate roof protecting system in process 900. Whether to activate the system in process 900 takes into consideration some or all information provided from various inputs. The location of hail and information about its size and intensity, and the likely length of the storm, may be obtained from input 902. The decision also may include confirmation of the activation of neighboring systems from input 904. Weather alerts and emergency broadcasts at input 906 also may be considered, as may information from system sensors at input 908. These and other information inputs may be considered to have an automatic decision to activate roof protecting system 100 at process 900. Also, process 900 may include a manual start instruction input 910 and will therefore start.

While various embodiments of the disclosure have been described, the description is intended to be exemplary, rather than limiting and it will be apparent to those of ordinary skill in the art that many more embodiments and implementations are possible that are within the scope of the disclosure. Accordingly, the disclosure is not to be restricted except in light of the attached claims and their equivalents. Also, various modifications and changes may be made within the scope of the attached claims.

We claim:

1. A roof protecting system for protecting a roof of a building against damage from hail, the system comprising:

a roof covering structure adapted to cover at least a portion of the roof;

the roof covering structure being capable of holding a non-Newtonian dilatant fluid;

a deployment system to dispose the roof covering structure onto the roof; and a delivery system for delivering the non-Newtonian dilatant fluid to the roof covering structure, wherein the delivery system includes a storage volume for a solid, wherein when the solid is combined with a liquid, the non-Newtonian dilatant fluid is formed;

a first conduit for delivery of the solid to a control system; and a second conduit for delivery of the liquid to the control system;

wherein the control system controls delivery of the solid and the liquid to a plenum in proportions that can be mixed to form the non-Newtonian dilatant fluid;

wherein the solid and the liquid undergo mixing to form the non-Newtonian dilatant fluid; and wherein the roof covering structure is fluidly connected to the plenum to receive the non-Newtonian dilatant fluid from the plenum.

2. The system of claim 1, wherein the solid comprises cornstarch and the liquid comprises water.

3. The system of claim 1, wherein the system further comprises the control system, the control system being configured to control deployment of the roof covering system by the deployment system; and the control system being configured to control delivery of the non-Newtonian dilatant fluid to the roof covering structure by the delivery system.

4. The system of claim 3, wherein the control system is autonomous and is adapted to receive information from weather alerts and broadcasts, system hail sensors, neighboring systems, and reports of the location and severity of hail.

5. The system of claim 3, wherein the control system is manually operable.

* * * * *